US005971641A

United States Patent [19]

Looney

[11] Patent Number: 5,971,641

[45] Date of Patent: Oct. 26, 1999

[54] CARRIAGE DRIVEN TRAY LOWERING DEVICE FOR AN INK JET PRINTER

[75] Inventor: John H. Looney, Fairport, N.Y.

[73] Assignee: Xerox Corporation, Stamford, Conn.

[21] Appl. No.: 09/087,876

[22] Filed: Jun. 1, 1998

[51] Int. Cl.[6] ..... B41J 11/58

[52] U.S. Cl. ..... 400/628; 400/624; 347/104

[58] Field of Search ..... 400/185, 600.1, 400/600.2, 600.4, 624, 628, 644; 347/104; 271/118, 117, 157

[56] References Cited

U.S. PATENT DOCUMENTS 4,491,854 1/1985 Habelt et al. ..... 346/136
5,380,106 1/1995 West ..... 400/185
5,393,152 2/1995 Hattori et al. ..... 400/691
5,464,291 11/1995 Kimura et al. ..... 400/185
5,674,016 10/1997 Kimura et al. ..... 400/185
5,730,538 3/1998 Kato ..... 400/702.1

*Primary Examiner*—Edgar Burr
*Assistant Examiner*—Daniel J. Colilla
*Attorney, Agent, or Firm*—William A. Henry, II

[57] ABSTRACT

A liquid ink printing machine, for forming an image on a recording medium moving along a path, including an arrangement for reducing media feedhead loads on media being fed in the printing machine. This is accomplished by using the printing machine's printhead carriage to contact a lever which will lower a paper tray holding the media once media being fed has reached an advance nip past the feedhead, thus reducing drag on the media being fed.

21 Claims, 2 Drawing Sheets

CARRIAGE DRIVEN TRAY LOWERING DEVICE FOR AN INK JET PRINTER

FIELD OF THE INVENTION

This invention relates generally to liquid ink printers, and more particularly, to a carriage driven tray lowering device for such printers.

BACKGROUND OF THE INVENTION

Liquid ink printers of the type frequently referred to as continuous stream or as drop-on-demand, such as piezoelectric, acoustic, phase change wax-based or thermal, have at least one printhead having drop ejectors from which droplets of ink are directed towards a recording sheet. Within the printhead, the ink is contained in a plurality of channels. Power pulses cause the droplets of ink to be expelled as required from orifices or nozzles at the end of the channels.

In a thermal ink-jet printer, the power pulses are usually produced by resistors, each located in a respective one of the channels, which are individually addressable to heat and vaporize ink in the channels. As voltage is applied across a selected resistor, a vapor bubble grows in the associated channel and initially the ink bulges from the channel orifice. The bubble quickly collapses and the ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has one or more relatively small printheads containing the ink channels and nozzles. The printheads can be sealingly attached to one or more disposable ink supply cartridges and the combined printheads and cartridge assembly is attached to a carriage which is reciprocated to print one swath of information (equal to the length of a column of nozzles), at a time, on a stationary recording medium, such as paper or a transparency. After the swath is printed, the paper can be stepped a distance equal to the height of the printed swath or a portion thereof, so that the next printed swath is contiguous or overlapping therewith. This procedure is repeated until the entire page is printed.

In a typical ink-jet printing machine, the carriage must transport the printhead assembly across the page for printing as the recording medium is held stationary. After the printhead has scanned across the medium, the medium is advanced by a transport which typically includes a transport roller driven by a gear assembly which is in turn driven by a motor. In one example of an ink jet printer, the motor is a stepper motor which provides for accurate control of the medium advance by being coupled to the gear assembly which includes a number of gears for reducing the advance of the motor by the appropriate amount to, for instance, print at 300 dots per inch (dpi) or 600 dpi.

An ink jet printer's paper advance mechanism must be accurate to reduce mismatch between swaths. Among other things, this means reducing forces competing for the paper during imaging. One major force is that required for feeding. Some printers disengage the feed rolls by using the advance motor to retract the feed platform after the paper is in the advance nip. This is effective, but can compromise advance accuracy or constrain feed capacity. Thus, there is a need to reduce media drive loads during printing.

Various methods and apparatus of printing with liquid ink printers having an advance mechanism including a transport are described in the following disclosure which may be relevant to certain aspects of the present invention.

In U.S. Pat. No. 4,491,854 to Habelt et al., a printer with a guide ruler for flattening a record carrier is described. The record carrier is fed around a transport roller and over an elongated flat supporting surface extending alongside the roller, with a printing head displaceable along that surface. The transport roller can be rotated either by means of a handwheel connected thereto or by means of a motor, via a gearwheel drive.

SUMMARY OF THE INVENTION

In accordance with one aspect of the present invention, there is provided a printing machine for forming an image on a recording medium moving along a path. The printing machine includes a cost effective way of achieving tray articulation while printing is occurring without introducing motion quality errors into the print by using a printhead carriage to contact a lever which through a linkage mechanism will lower the tray and thus reduce drag on media being fed from the tray once the media has reached an advanced nip past the feeder.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
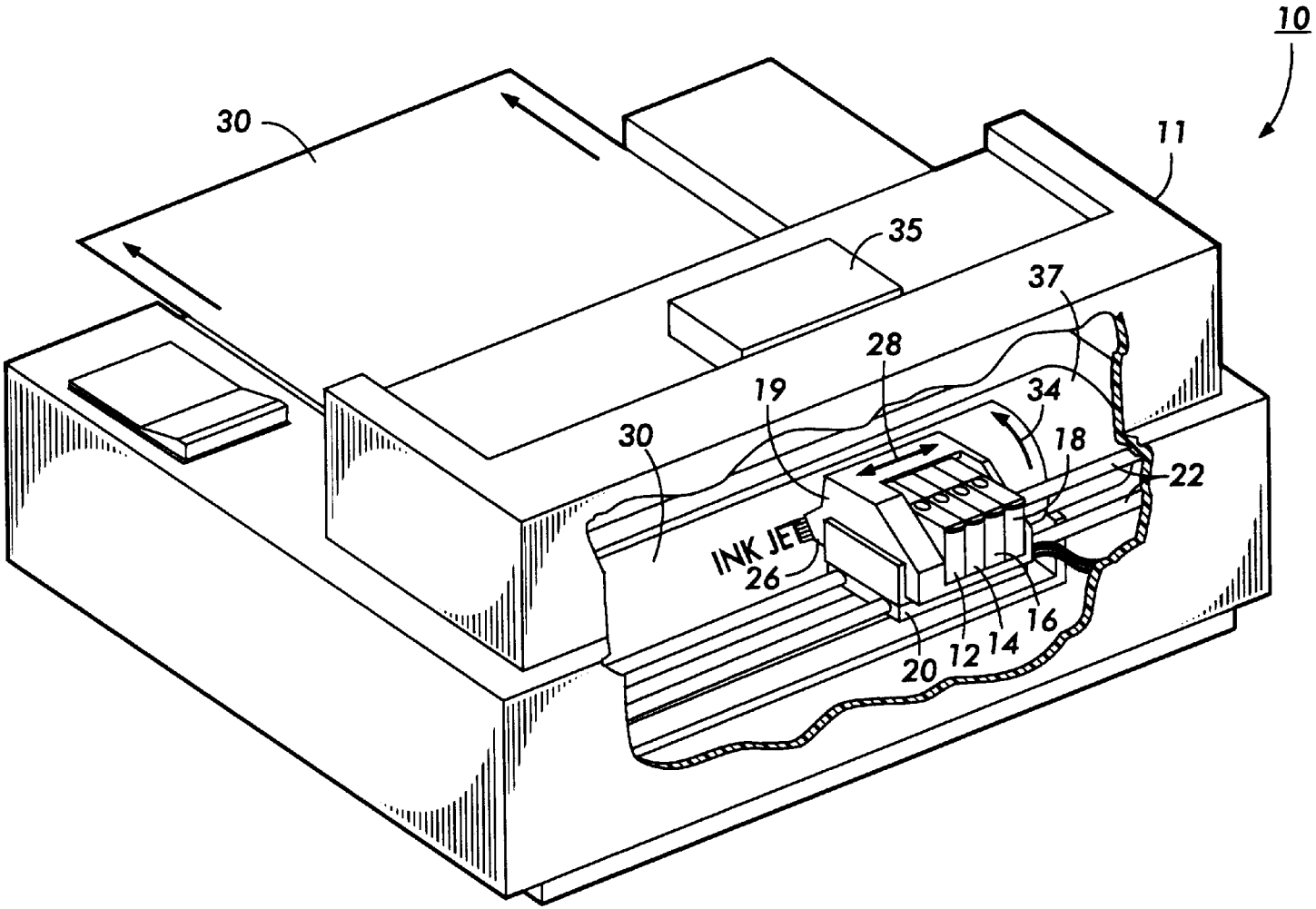
FIG. 1 illustrates a perspective view of a color ink jet printer incorporating the present invention.

FIG. 1 illustrates a perspective view of a color thermal ink jet printer 10 which incorporates a preferred embodiment of the present invention. Printer 10 is exemplary only. The invention can be practiced in other types of thermal ink jet printers, as well as other reproduction devices including liquid ink printers driven by signals from a document raster input scanner or signals received from a computing device, such as a personal computer. Printer 10 includes four ink jet ink containers 12, 14, 16, and 18 mounted in a print cartridge 19 on a carriage 20 supported by carriage rails 22. The carriage rails 22 are supported by a frame 11 of the ink jet printer 10. The printhead cartridge which comprises the ink containers contains ink for supply to a thermal ink jet printhead 26 which selectively expels droplets of ink under control of electrical signals received from a controller (not shown) of the printer 10 through an electrical cable (not shown). The printhead 26 contains a plurality of ink channels (not shown) which carry ink from one or more of the ink containers 12, 14, 16, and 18 to respective ink ejecting orifices or nozzles of the printhead 26.

When printing, the carriage 20 reciprocates or scans back and forth along the carriage rails 22 in the direction of an arrow 28. As the printhead 26 reciprocates back and forth across a recording medium 30, for instance, of sheets of paper or transparencies, droplets of ink are expelled from selected ones of the printed nozzles towards the recording medium 30. The ink ejecting orifices or nozzles are typically arranged in a linear array perpendicular to the scanning direction 28. During each pass of the carriage 20, the recording medium 30 is held in a stationary position. At the end of each pass, the recording medium is stepped in the direction of an arrow 34. For a more detailed explanation of the printhead and printing thereby refer to U.S. Pat. No. 4,571,599 and U.S. Pat. No. Re. 32,572, the relevant portions of which are incorporated herein by reference.

The single recording sheet 30 is fed from an input stack by feed rolls 33 (FIG. 2), captured by advance rolls (not shown) and fed through the printer along a path defined by a curved platen 37 and a guide member (not shown). As the recording medium 30 exits the slot between the platen 37 and the guide member (not shown), the sheet 30 is caused to reverse bow such that the sheet is supported by the platen 37 at a flat portion thereof for printing by the printhead 26.

Figure 2:
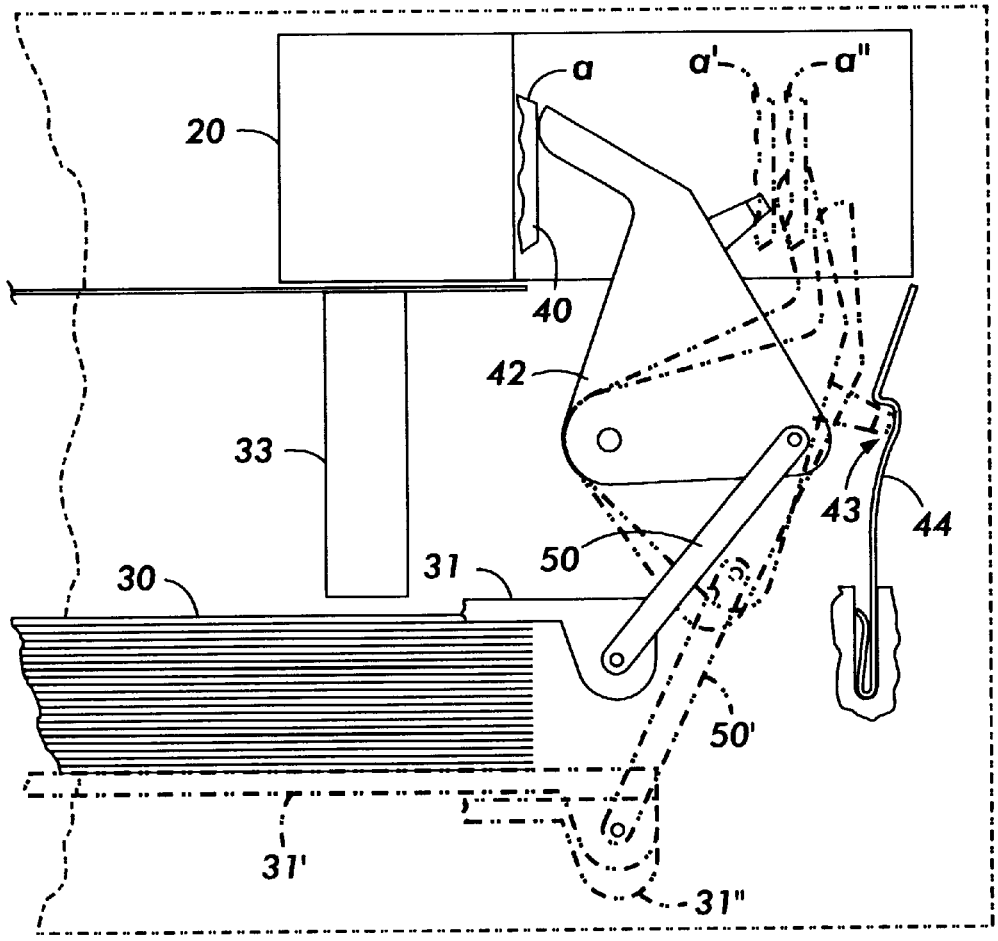
FIG. 2. illustrates an enlarged, schematic, partial end view of the carriage stroke tray retractor of the present invention incorporated into the color ink jet printer of FIG. 1.

As shown in FIG. 1, and in accordance with the present invention, carriage 20 moves on carriage rails 22 over the sheet 30, stopping to reverse at each end in accordance with conventional signals from a controller 35. At the left end as viewed in FIG. 1, is found a maintenance station. The other or right end, as shown in FIG. 2, provides space for turnaround of the carriage, but otherwise is unused. A conventional swath drive motor (not shown) when signaled by controller 35, pushes carriage 20 into the turnaround section so that the carriage abutment 40, is moved against the end of a lever 42. Carriage abutment 40 can be a separate member from carriage 20 or integrally attached to the carriage. After displacing the lever a few centimeters from position (a) to position (a'), an appropriate portion of lever 42 is engaged at 43 by hook 44 so that it will not return. This is at position (a'). Lever 42 has link member 50 and paper tray 31 attached thereto and during displacement of lever 42, link member 50 and paper tray 31 are moved downward. This action disengages feed roll 33 which has just fed a sheet from paper tray 31. During this action, link member 50 and tray 31 are moved to the position shown in phantom by link member 50' and tray 31'. Thus, the sheet has no feed load on it. The print process continues with the carriage performing turnarounds in the space where lever 42 has been latched out of reach.

When printing on the fed sheet has been completed, it is either the end of the job or another sheet must be fed. If the fed sheet is the last sheet of a particular job, the carriage parks at the maintenance station, leaving lever 42 latched into hook 44 so that tray 31 is held down. This allows the user to address tray 31 and either load or unload copy sheets.

If the fed sheet is not the last sheet in a job, the carriage goes to the turnaround space where it's abutment 40 engages lever 42 at position (a') and pushes the lever a few millimeters further to position (a"). When lever 42 is moved to position (a"), feed tray 31 through link member 50 is moved to the position shown in phantom as 31". This causes latch 44 to disengage. Now the carriage 20 backs away allowing the bottom of feed tray 31 to raise a variable amount depending on the quantity of paper in it.

In recapitulation, there has been described a method and apparatus for reducing media loads (which can cause image quality defects) in an ink jet printer. This is accomplished by using a printhead carriage to contact a lever which will lower a media tray (and thus reduce drag on media) once the media has reached an advance nip past a feeder. The mode of operation is as follows: 1) at the end of each job, the tray is parked in a down position which allows for easy loading of media; 2) when print is selected, the carriage pivots the tray lever past a lock position which allows the media tray to raise to a feed position; 3) the media is fed and when it is determined (through a sensor) that the media is in an advance nip, the carriage moves over to contact the lever and pivot the tray back to a down position; 4) the carriage then moves back to a print position until the next sheet is ready to be fed. Thus, a cost effective way of reducing image disturbance in an ink jet printer is achieved involving only three parts, consisting of a lever that can be molded in filled plastic, a link that can be a wire form, and a flat spring having the special feature of a latch. It is, therefore, apparent that there has been provided in accordance with the present invention an ink jet printer paper advance mechanism that reduces image mismatch between swaths that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An arrangement that reduces mismatch between swaths of printing in an ink jet printer, comprising;

a carriage having an abutment member thereon;

carriage rails on which said carriage is mounted for movement from a home position at one end of said carriage rails to an opposite end of said carriage rails and back to said home position;

a printhead positioned within said carriage;

a motor connected to said carriage and adapted to move said carriage in a predetermined path away from said home position to said opposite end of said carriage and back to said home position;

a multi-positionable lever positioned to be contacted and moved by said abutment member and said carriage as said carriage is moved in said predetermined path;

a latch member adapted to capture said lever when said lever is moved by said carriage and abutment member;

a link member connected to said lever and adapted for movement by said lever to multiple positions; and a controller that controls said carriage in accordance with printing requirements.

2. The arrangement of claim 1, wherein said lever includes an appendage portion extending therefrom that is adapted to mate with a hook portion of said latch member.

3. The arrangement of claim 2, wherein said lever is made of molded filled plastic.

4. The arrangement of claim 2, wherein said latch member is resilient.

5. The arrangement of claim 4, wherein said latch member is a flat spring.

6. The arrangement of claim 1, wherein said link is a wire form.

7. The arrangement of claim 6, including a paper tray pivotally attached to said link.

8. The arrangement of claim 7, wherein said link member is adapted to lower said tray when said link member is in a second position and to lower said tray further when said link member is in a third position.

9. A method for reducing media loads and thereby image quality defects in an ink jet printer during printing, comprising the steps of:

providing a media tray;

providing a carriage adapted to move from a first position to a second position and back to the first position;

providing a movable lever connected to said media tray such that said media tray is moved when said lever is moved;

moving said printer carriage;

contacting said lever with said carriage and thereby moving said media tray from a first position to a second position; and controlling movement of said carriage with a controller.

10. The method of claim 9, including the step of inserting additional media into said media tray while said media tray is in said second position.

11. The method of claim 10, including the step of contacting said lever with said carriage and thereby moving said media tray from a second position to a third position when continued printing is required.

12. An apparatus for reducing media loads and thereby image quality defects in an ink jet printer during printing, comprising:

a media tray;

a printhead;

a carriage mounted for movement from a first position to a second position and then to a third position and thereafter back to said first position;

a movable lever connected to said media tray such that said media tray is moved when said lever is moved;

a motor for moving said carriage, said carriage being adapted to contact said lever and thereby move said media tray from a first position in contact with said printhead to a second position out of contact with said printhead; and a controller for controlling movement of said carriage.

13. The apparatus of claim 12, including a latch member, said latch member including a hook portion therein, and wherein said hook portion of said latch member is adapted to hold said movable lever when said carriage is in said second position.

14. The apparatus of claim 13, wherein movement of said carriage to said third position forces release of said movable lever from said hook portion of said latch member.

15. The apparatus of claim 14, including a link member connected to said movable lever and adapted to push against said media tray when said carriage is moved to said second position.

16. The apparatus of claim 15, wherein said link member is adapted to move away said media in said media tray downward when said carriage is moved to said third position.

17. An ink jet printer includes a device that reduces mismatch between swaths of printing, comprising;

a carriage adapted for movement in a predetermined path from a first position to a second position and back to said first position;

a printhead positioned within said carriage;

a multi-positionable lever positioned to be contacted and moved by carriage as said carriage is moved in said predetermined path;

a latch member adapted to capture said lever when said lever is moved by said carriage;

a link member connected to said lever and adapted for movement by said multi-positionable lever to multiple positions; and a controller that controls movement of said carriage in said predetermined path in accordance with printing requirements.

18. The apparatus of claim 17, wherein said latch member includes a hook portion therein, and wherein said hook portion of said latch member is adapted to hold said multi-positionable lever when said carriage is in said second position.

19. The apparatus of claim 18, wherein said carriage is adapted for movement to a third position, and wherein movement of said carriage to said third position forces release of said multi-positionable lever from said hook portion of said latch member.

20. The apparatus of claim 19, including a media tray with media therein, and wherein said link member is adapted to push against media in said media tray when said carriage is moved to said second position.

21. The apparatus of claim 20, wherein said link member is adapted to move said media in said media tray away from feed rolls when said carriage is moved to said third position.

* * * * *